United States Patent [19]

Dubied et al.

[11] 4,060,939

[45] Dec. 6, 1977

[54] DEVICE OF PLANE-PARALLEL TREATMENT OF SURFACES

[75] Inventors: Gilbert Dubied, Vilars; Ernst Kuenzi, Corcelles, both of Switzerland

[73] Assignee: Laboratoire Suisse de Recherches Horlogeres, Switzerland

[21] Appl. No.: 693,753

[22] Filed: June 8, 1976

Related U.S. Application Data

[63] Continuation-in-part of Ser. No. 581,090, May 27, 1975, abandoned.

[30] Foreign Application Priority Data

June 5, 1974 Switzerland ..... 7770/74

[51] Int. Cl.[2] ..... B24B 25/00

[52] U.S. Cl. ..... 51/157

[58] Field of Search ..... 51/113, 83, 157, 118, 51/114

[56] References Cited

U.S. PATENT DOCUMENTS

| | | | |
|---|---|---|---|
| 1,257,047 | 2/1918 | Suverkrop | 51/157 X |
| 1,485,321 | 2/1924 | Wilkinson | 51/113 |
| 1,491,101 | 4/1924 | Hoke | 51/157 |
| 2,085,005 | 6/1937 | Cole | 51/118 |
| 2,168,596 | 8/1939 | Hall | 51/118 |
| 3,127,707 | 4/1964 | Burt | 51/83 R |

*Primary Examiner*—Harold D. Whitehead

*Attorney, Agent, or Firm*—Stevens, Davis, Miller & Mosher

[57] ABSTRACT

A device of simultaneous surface-treatment of two parallel plain surfaces of a worked article consisting of two immobile polishing blocks one serving likewise as support for the piece to be treated which is exposed to a combination of longitudinal and transverse movements of translation being independently adjustable with regard to the velocity and the course of the movement.

8 Claims, 4 Drawing Figures

DEVICE OF PLANE-PARALLEL TREATMENT OF SURFACES

This application is a continuation-in-part of application Ser. No. 581,090 filed May 27, 1975, now abandoned.

The present invention relates to a device for treatment of parallel surfaces.

It is the object of the invention to provide a device permitting the simultaneous treatment of two parallel faces of the same piece with a very small tolerance of parallelism and an excellent quality of the surface.

The device being the object of this invention is characterized by the fact that the piece to be treated is placed between two immobile polishing blocks and the superior one serves as support for the piece to be treated. The piece is exposed to a combination of two movements of translation, one of longitudinal and the other one of transverse direction, the velocity and the course of the two movements being independently adjustable from each other and in this way adaptable to the material and the shape of the piece to be treated.

The known devices for parallel-plane treatment of surfaces are characterized by the fact that the polishing blocks are exposed to a circular movement and that the polishing of two parallel faces of the same piece is effected successively. The present invention gives the advantage of eliminating the necessary operation of cleaning the pieces after polishing the first face. On the other side the utilization of two movements of translation permits the elimination of the manual finishing of certain pieces, for instance standards or calibration pieces.

The invention will be more clearly understood from the following description in conjunction with the accompanying drawings, in which.

Figure 1:
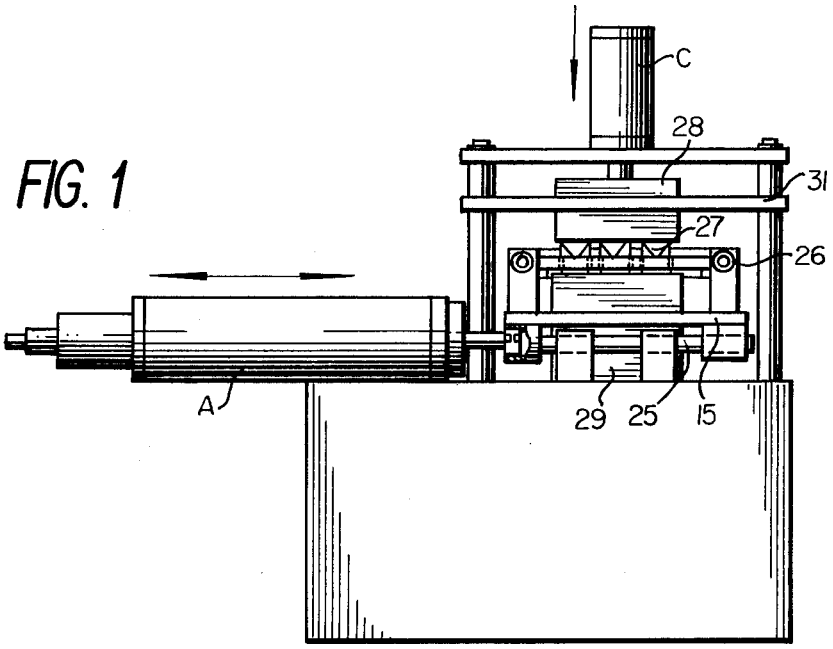
FIG. 1 is a schematic side-view.
Figure 2:
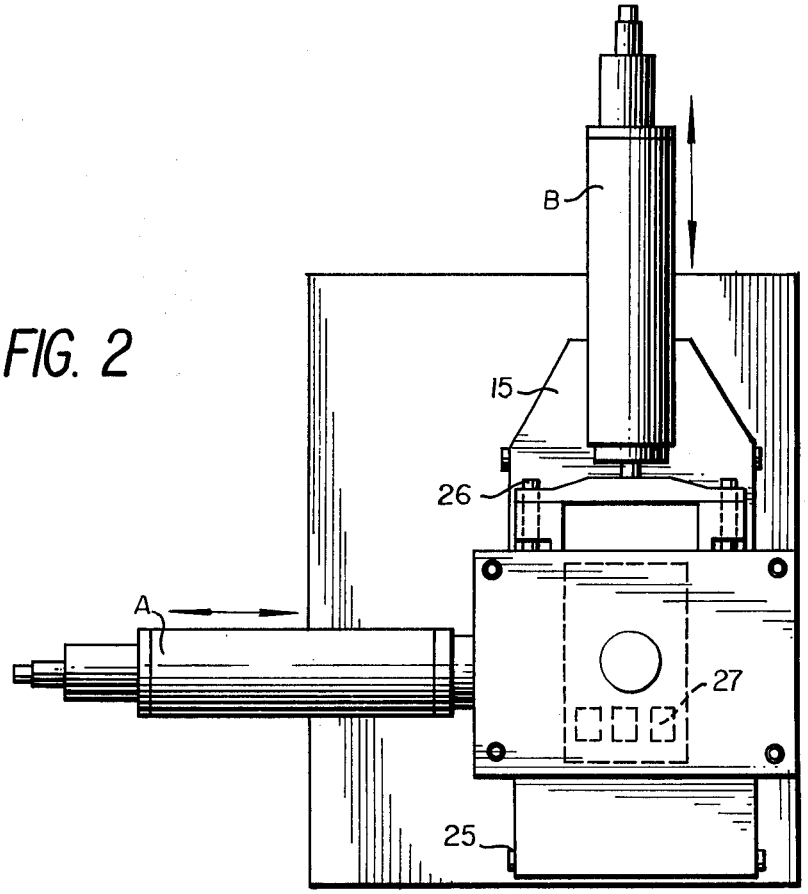
FIG. 2 is a view from the top of a device which is also schematic and an exemplary performance of the invention.

From FIGS. 1 and 2, it can be seen that the device consists of two hydropneumatic systems A and B for longitudinal and transverse movements of translation. The system B for the longitudinal movement is set up on a plate 15 which is combined with the transverse movement of A. The courses and the velocities of the two systems are independently adjustable, the courses being limited by the final interrupter of course and the velocities regulated by a throttle mechanism as will hereinafter appear. The movements of A and B are guided by two similar systems at 25 and 26 each consisting of two columns on which longitudinal rollerbearings glide. The pieces to be polished 27 are placed between the polishing blocks 28 and 29 in the hollows of a driving plate 30 the dimensions of these hollows being adapted to those of the pieces 27 to be polished. The movement of the plate 30 is conditioned by the systems A and B. The polishing block 28 is maintained in a fixed position by the plate 31. The system of charging C permits adjustment of the applicable charge on the pieces to be treated.

Figure 3:
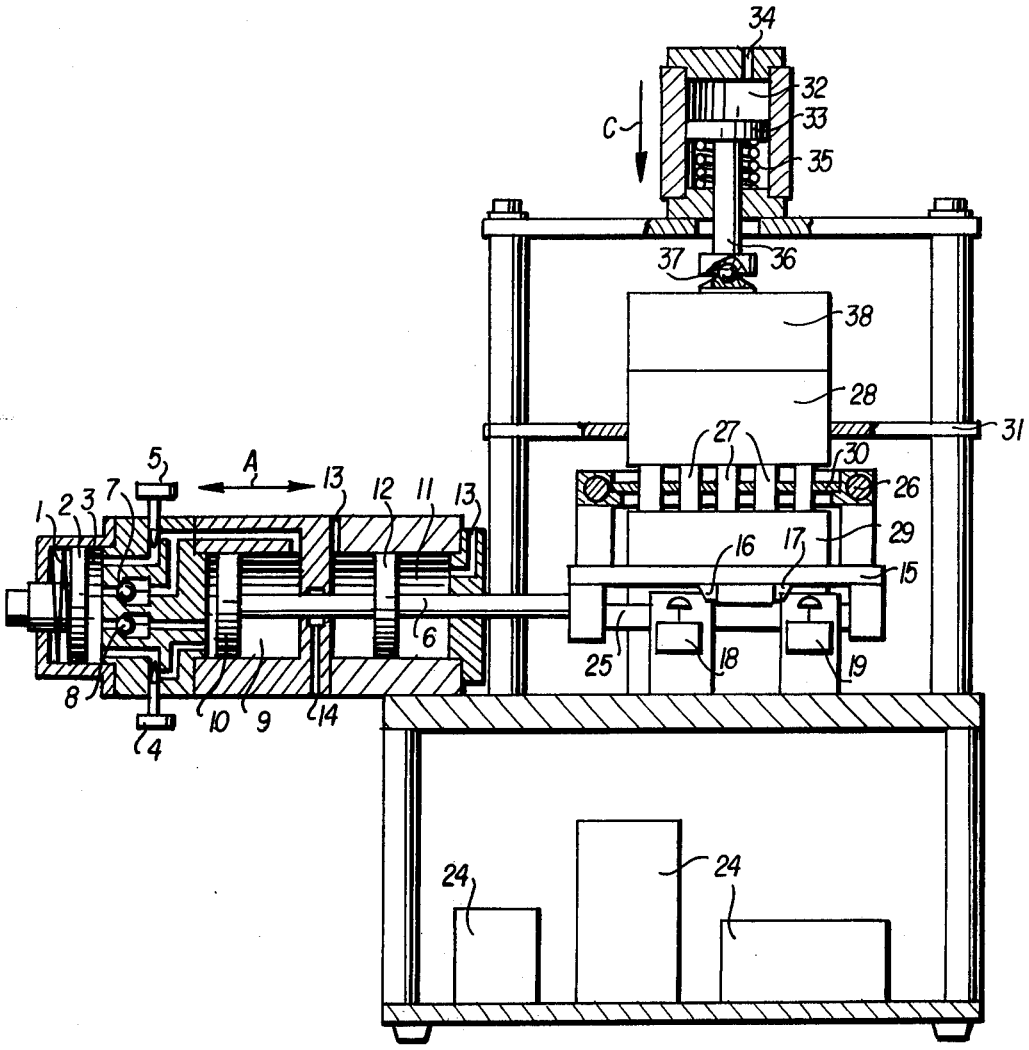
FIG. 3 is a detailed view partially in side elevation and partially in section.
Figure 4:
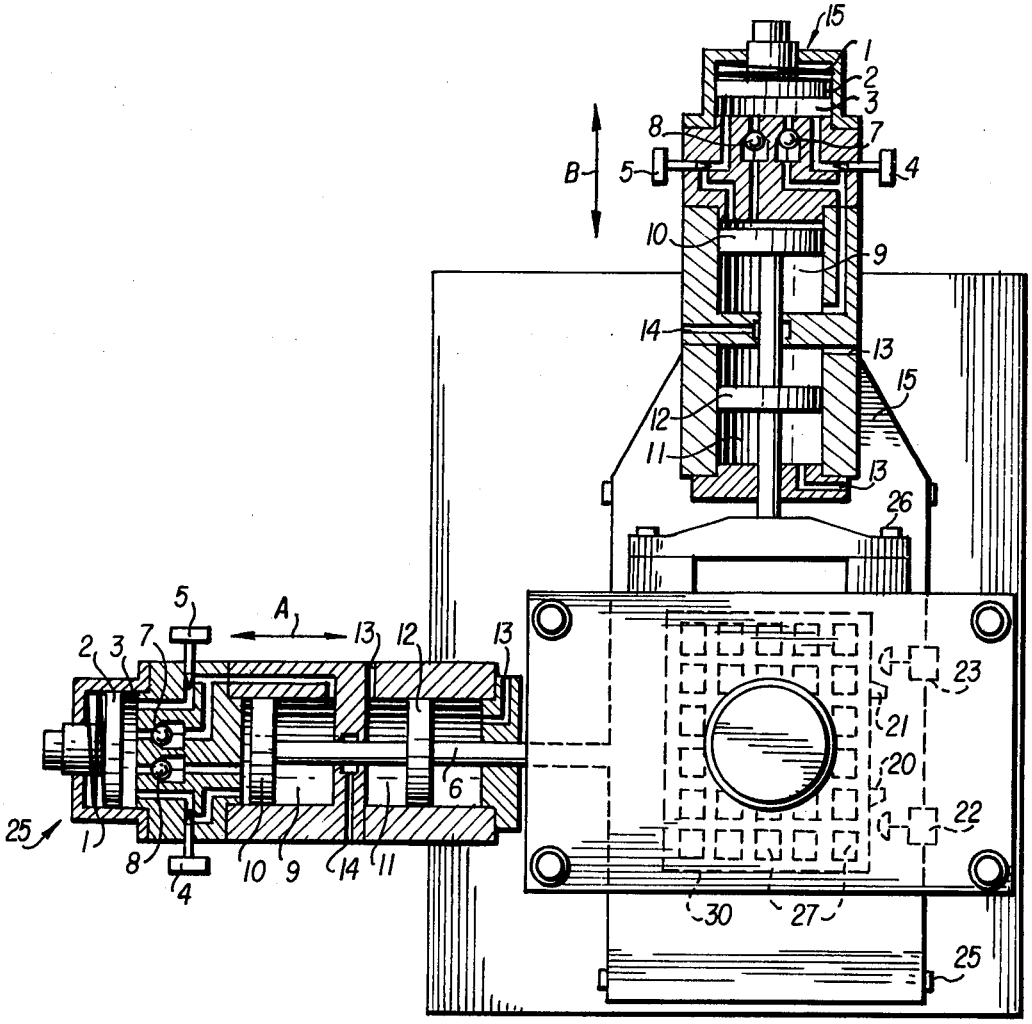
FIG. 4 is a detailed view partially in top plan and partially in section.

The details of the invention are appreciated by reference to FIGS. 3 and 4 in which the operating elements are:

Spring 1 providing the pressure for the balance piston 2, which acts on the oil volume of chamber 3.

Throttles 4 and 5 together with non-return valves 7 and 8 which allow the independent regulation of the lead and slip velocities of the piston rod 6, which is actuated by the hydraulic cylinder 9 and the adjusting piston 10.

The whole hydropneumatic systems are driven by the piston 12 of the pneumatic cylinder 11.

The orifices 13 serve as compressed air inlet and outlet. The pressure-less chamber 14 avoids the inlet of air in the hydraulic cylinder 9.

The system for the longitudinal movement B is mounted on a plate 15, which is driven by the transverse system A.

The velocities of the two hydropneumatic systems A, B are independently adjustable with throttles 4 and 5.

The courses of systems A and B are adjustable and limited by cam-systems (16, 17 for system A; 20, 21 for system B) and end of course interruptors (18, 19 for system A; 22, 23 for system B).

The pneumatic cylinders 11 of the systems A and B are regulated by the electrical compressed-air elements 24. These are steered by the end of course interruptors 18, 19, 22, 23 and the pneumatic cylinder 11 by the pressure of the compressed-air introduced through the orifices 13.

The end of course interrupters (18, 19 for example) are shown to be attached to the immobile portions of the system, and when one of the cams 16 or 17 passes one of the interrupters, the interrupter electrically activates element 24 of the compressed air system to limit further transverse movement of the plate 15 upon which the cams 16, 17 appear. Similarly cams 20, 21 interact with interrupters 22, 23 to electrically activate the compressed air system thereby limiting longitudinal movement of plate 30.

The movements A and B are guided by two similar systems 25 and 26. Each one consisting of two columns gliding on longitudinal roller bearings.

The pieces to be polished 27 are placed between the polishing blocks 28 and 29 in the hollows of the driving plate 30, the dimensions of these hollows being adjusted to those of the pieces to be polished 27.

The movement of plate 30 is determined by the velocities and the courses of the systems A and B.

The loading system C consists of a pneumatic cylinder 32 and a single-seated piston 33, which is pushed to the top by spring 35 when the loading system is not used.

The working pressure is determined by the compressed air pressure introduced through orifice 34 into the pressure chamber of the cylinder 32. The pressure is transmitted by the rod 36 of piston 33 to an articulated joint 37 and to plate 38 which is located on the top surface of the upper polishing block 28. The pressure is applied by the plate 38 to the polishing block 28.

EXAMPLE 1

40 pieces of standard (9 × 30 × 8 mm) of tempered steel having a hardness of 815 Vickers are polished. The parallelism of each of the pieces is respected to 1/10 micron. For the whole of 40 pieces the difference of thickness does not exceed 2/10 micron.

EXAMPLE 2

8 working plates for the watch-making industry coated with titanium carbide having a hardness of 4300 Vickers are polished.

For the whole of 8 pieces the differences measured on the thickness as well as on the parallelism do not exceed 2/10 micron.

What is claimed is:

1. A device for simultaneously treating two plane parallel surfaces of an article, wherein said device comprises:

one lower and one upper planar polishing blocks, the lower polishing block adapted for supporting an article to be treated, fluid cylinder means for simultaneously subjecting an article to longitudinal and transverse movements between and in contact with said polishing blocks; and means for independently controlling the velocity and extent of each of said longitudinal and transverse movements, respectively.

2. The device of claim 1, additionally comprising means for varying the pressure applied to an article between said polishing blocks.

3. The device of claim 1, wherein said fluid cylinder means comprises a first fluid cylinder system for transversely moving a plate supporting said lower polishing block, and a second fluid cylinder system also supported by said plate and for longitudinally moving an article between said polishing blocks.

4. The device of claim 3 additionally comprising holding means attached to said second fluid cylinder system, said holding means for holding and moving a plurality of articles between said polishing blocks.

5. The device of claim 3 wherein at least one of said first and second fluid cylinder systems comprises two pistons having a common axis aligned in the direction of movement for that respective fluid cylinder system, said pistons being within separate fluid cylinders, one of said two pistons for moving that system in its axial direction, and the other of said two pistons for controlling the speed of movement of that system.

6. The device of claim 5, wherein said other piston also has throttle valves for controlling the flow of fluid to each side of said other piston.

7. The device of claim 6 additionally comprising holding means attached to said second fluid cylinder system, said holding means for holding and moving a plurality of articles between and in contact with said polishing blocks.

8. The device of claim 5, additionally comprising means associated with said one piston and its cylinder for limiting the extent of movement of said one piston, thereby limiting the extend of movement of the article being treated.

* * * * *